US010935014B2

(12) United States Patent
Keuerleber

(10) Patent No.: US 10,935,014 B2
(45) Date of Patent: Mar. 2, 2021

(54) COMPRESSOR

(71) Applicant: GEA Bock GmbH, Frickenhausen (DE)

(72) Inventor: Jörg Keuerleber, Oberboihingen (DE)

(73) Assignee: GEA BOCK GMBH

( * ) Notice: Subject to any disclaimer, the term of this patent is extended or adjusted under 35 U.S.C. 154(b) by 0 days.

(21) Appl. No.: 15/322,993

(22) PCT Filed: Jul. 6, 2015

(86) PCT No.: PCT/EP2015/001370
§ 371 (c)(1),
(2) Date: Dec. 29, 2016

(87) PCT Pub. No.: WO2016/005043
PCT Pub. Date: Jan. 14, 2016

(65) Prior Publication Data

US 2017/0184330 A1 Jun. 29, 2017

(30) Foreign Application Priority Data

Jul. 8, 2014 (DE) ..... 10 2014 010 018.9

(51) Int. Cl.
*F04B 39/00* (2006.01)
*F04B 39/12* (2006.01)
(Continued)

(52) U.S. Cl.
CPC ..... *F04B 39/0055* (2013.01); *F04B 39/0061* (2013.01); *F04B 39/122* (2013.01);
(Continued)

(58) Field of Classification Search
CPC ..... F04B 39/0055; F04B 39/0061; F04B 39/0066; F04B 39/0072; F04B 39/122;
(Continued)

(56) References Cited

U.S. PATENT DOCUMENTS 1,688,889 A * 10/1928 Spreen ..... F04B 39/0016 417/553
4,412,791 A 11/1983 Lal
(Continued)

FOREIGN PATENT DOCUMENTS

DE 2 03 937 A1 11/1983
DE 38 40 715 A1 6/1989
(Continued)

OTHER PUBLICATIONS

International Search Report dated Dec. 14, 2015 issued in corresponding International patent application No. PCT/EP2015/001370.
(Continued)

*Primary Examiner* — Kenneth J Hansen
(74) *Attorney, Agent, or Firm* — Ostrolenk Faber LLP

(57) ABSTRACT

A compressor (10), in particular a compressor for compressing a coolant, including one or more pistons (12), a cylinder block (16), and a compressor housing which at least partially houses the compressor (10), the piston(s) (12) being arranged in corresponding cylinder bores or cylinders (14) arranged at least partially in the cylinder block (16) and/or in the compressor housing so that they can move back and forth. The compressor (10) also includes an impedance tube (36) and an outlet (30) for releasing the coolant from the compressor, (10) in particular an outlet flange (32). Said compressor (10) has an associated high pressure volume (24), for one or more, in particular, for respectively two cylinders (14), and a common high pressure volume (26), in which the individual high pressure volumes (24) join, the common high pressure volume (26) being connected to the outlet (30) and the impedance tube (36) being arranged in the connection between the common high pressure volume (26) and the outlet (30) or the connection is created between the common high pressure volume (26) and the outlet (30). The invention also relates to a corresponding coolant circuit and to a corresponding air-conditioning system.

18 Claims, 1 Drawing Sheet

(51) Int. Cl.

| | |
|---|---|
| ***F04B 49/03*** | (2006.01) |
| ***F25B 9/00*** | (2006.01) |
| ***F25B 31/02*** | (2006.01) |
| ***F25B 41/04*** | (2006.01) |
| ***F04B 53/10*** | (2006.01) |

(52) U.S. Cl.
CPC ..... *F04B 49/03* (2013.01); *F04B 53/1077* (2013.01); *F25B 9/008* (2013.01); *F25B 31/023* (2013.01); *F25B 41/04* (2013.01); *F04B 2201/0807* (2013.01); *F25B 2500/13* (2013.01)

(58) Field of Classification Search
CPC .. F04B 49/03; F04B 53/1077; F04B 53/2201; F04B 53/0807; F01N 13/10; F01N 13/085
USPC ..... 181/237
See application file for complete search history.

(56) References Cited

U.S. PATENT DOCUMENTS 4,820,133 A 4/1989 Stelle et al.
5,101,931 A * 4/1992 Blass ..... F04B 39/0055 181/240
2009/0136366 A1 * 5/2009 Taguchi ..... F04B 27/1081 417/312

FOREIGN PATENT DOCUMENTS

DE 197 57 829 A1 7/1999
EP 0 926 363 A2 6/1999

OTHER PUBLICATIONS

Written Opinion dated Dec. 14, 2015 issued in corresponding International patent application No. PCT/EP2015/001370.
German Search Report dated Apr. 27, 2015 issued in corresponding German patent application No. 10 2014 010 018.9.

* cited by examiner

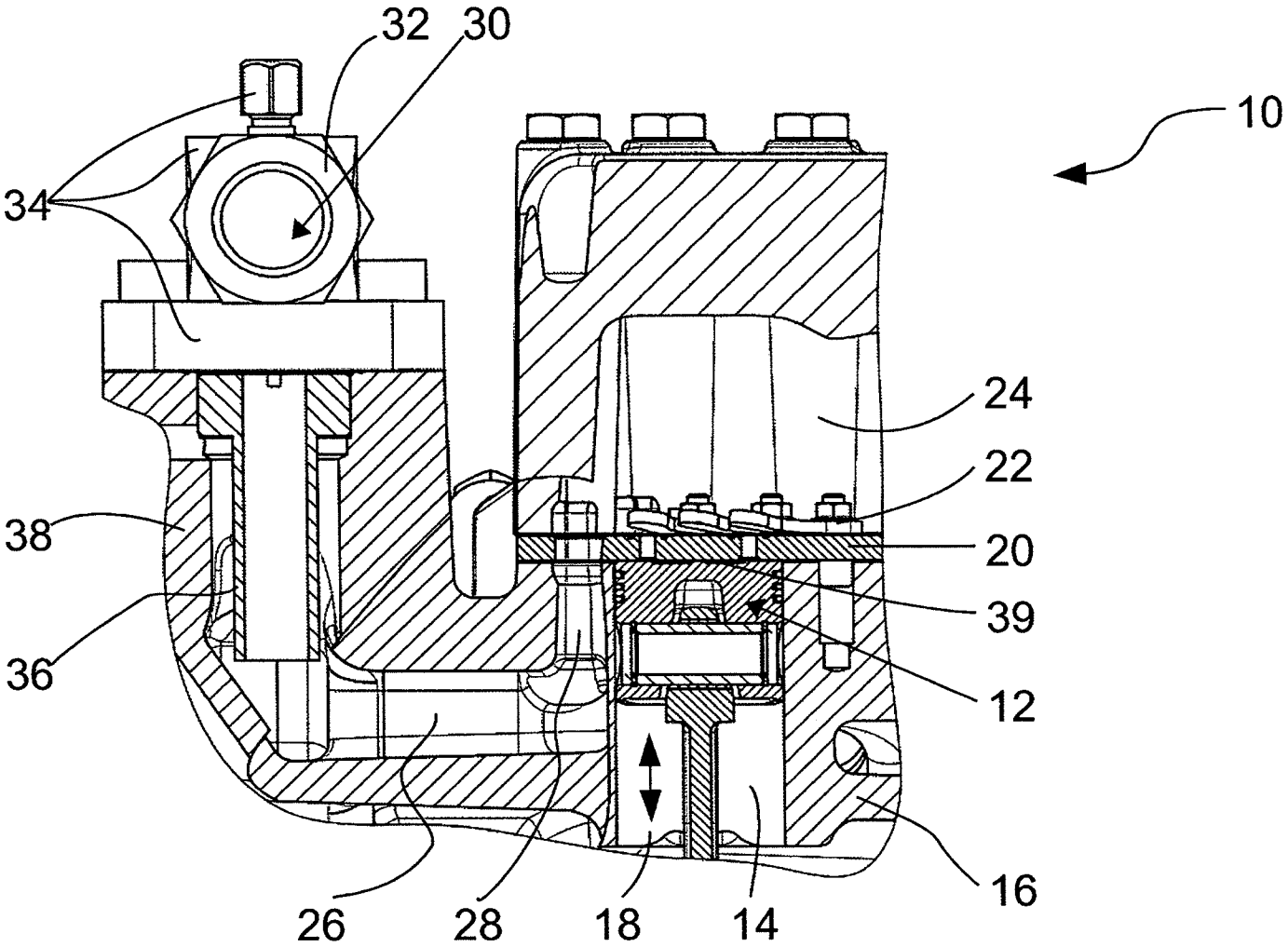
10
24
22
20
39
12
16
14
18
28
26
30
32
34
38
36

COMPRESSOR

CROSS-REFERENCE TO RELATED APPLICATIONS

The present application is a 35 U.S.C. §§ 371 national phase conversion of PCT/EP2015/001370, filed Jul. 6, 2015, which claims priority to German Patent Application No. 10 2014 010 018.9, filed Jul. 8, 2014, the contents of which are incorporated herein by reference. The PCT International Application was published in the German language.

TECHNICAL FIELD OF THE INVENTION

The invention relates to a compressor, and to a refrigeration system, and to an air conditioning system.

BACKGROUND OF THE INVENTION

Compressors of this type are used in various ways nowadays, for example in the field of climate control of motor vehicles, for example passenger vehicles or buses, in climate control of railway wagons, in the field of transport refrigeration or else in stationary applications such as supermarket refrigeration or an industrial use of heat pumps or the like. Furthermore, compressors of this type which are generally subject to the principle of pistons which move to and fro can be obtained in many embodiments, for example as reciprocating piston compressors, in which a piston movement takes place as a rule in a radial direction (with respect to a crankshaft axis direction of extent which at the same time defines the axial direction), the pistons as a rule being arranged, furthermore, spaced apart from one another at least partially in the axial direction; as radial piston compressors, in which the piston movement, that is to say a suction movement and a compression movement in the opposite direction to the former, takes place substantially in the radial direction, the pistons as a rule not being spaced apart from one another in the axial direction (radial engine geometry) or else as axial piston compressors, in which the suction and compression movement takes place substantially in an axial direction.

On account of the cyclical compression of the refrigerant, pulsations and the development of noise occur, in particular during the ejection of compressed refrigerant out of a cylinder, in which the corresponding piston moves to and fro.

In order to damp the pulsations, DE 197 57 829 A1 proposes a damper channel, via which compressed refrigerant passes from a pressure space which is connected downstream of the cylinder chamber into a high pressure volume which is common for all cylinders. The damper channel is as a rule equipped with a 90° bend, but in particular with a 180° bend, it being possible for part of the channel or else the entire channel to be formed by way of a tube, what is known as the impedance tube. Accordingly, the construction of DE 197 57 829 A1 is relatively complicated and therefore expensive to produce.

SUMMARY OF THE INVENTION

Proceeding from the above-discussed prior art, it is accordingly an object of the present invention to specify a compressor which has pulsation damping with a simultaneously simple construction, and to specify a corresponding refrigeration system and a corresponding air conditioning system.

Said object is achieved by way of a compressor as claimed in patent claim 1, a refrigeration system as claimed in patent claim 11, and an air conditioning system as claimed in patent claim 12.

Accordingly, a compressor, in particular a compressor for compressing a refrigerant, has one or more pistons and a cylinder block and/or a compressor housing. The pistons are arranged such that they can move to and fro in corresponding cutouts (cylinders or cylinder bores) which are arranged as a rule at least partially in the compressor housing and/or in the cylinder block. Furthermore, the compressor has an impedance tube and an outlet for outputting the refrigerant from the compressor, in particular an outlet flange. For in each case one or more, in particular in each case for two cylinders, a high pressure volume which is assigned to it or them is arranged in the compressor, into which high pressure volume said compressor ejects compressed refrigerant. Furthermore, the compressor has a common high pressure volume, into which the individual high pressure volumes open, the common high pressure volume being connected to the outlet. The impedance tube is arranged in the connection between the common high pressure volume and the outlet. In one possible embodiment, the connection between the common high pressure volume and the outlet is formed by way of the impedance tube.

This represents a simple construction which can be implemented inexpensively.

Refrigeration systems and/or air conditioning systems according to the invention have a compressor of corresponding configuration.

Further features of the invention are specified in the subclaims.

BRIEF DESCRIPTION OF THE DRAWING

The invention will be described by way of example in the following text with reference to the appended drawing using one embodiment. In the drawing:

FIG. 1 shows a partial view of one possible embodiment of a compressor according to the invention in a sectional view.

DESCRIPTION OF PREFERRED EMBODIMENTS

In the embodiment which is described, the compressor 10 which can be seen in FIG. 1 is a compressor which is provided for compressing a refrigerant, in particular $CO_2$. The compressor 10 has a plurality of pistons 12 (only one piston 12 is shown in the figure) which are arranged such that they can be displaced to and fro (indicated by way of a double arrow 18) in cutouts (cylinder bores) 14 which are arranged in the cylinder block 16. In the present embodiment which is described, this is a compressor 10 which is configured as a reciprocating piston compressor, that is to say a compressor 10, in which a suction movement and a compression movement (to and fro movement, indicated by way of a double arrow 18 as mentioned in the above text) take place in a radial direction, that is to say perpendicularly with respect to a crankshaft axis thereof. As an alternative, a configuration as an axial piston compressor would be conceivable, for example, in which a reciprocating movement takes place in the axial direction, that is to say parallel to the crankshaft axis.

In each case one cylinder chamber or compression volume is defined by way of the respective pistons 12, the cutouts (cylinder bores) or cylinders 14 and a covering or valve plate 20 which is arranged on the cylinder block 16. Refrigerant to be compressed is sucked into the cylinder chamber via inlet valves 21 during a suction movement of the pistons 12, in which the latter are moved away from the valve plate 20, which refrigerant is then compressed in a compression movement which is directed in the opposite direction (directed toward the valve plate 20) and is ejected through outlet valves 22 into a high pressure volume 24 which is assigned to the respective cylinder 14. In the present embodiment which is described, in each case two cylinders 14 share an associated high pressure volume 24. In the presently described embodiment, the inlet valves and the outlet valves are configured in each case as a lamellar valve, it being possible for any suitable valves to be used in alternative embodiments, such as annular valves or lamellar valves for example.

Furthermore, the compressor 10 has a common high pressure volume 26, into which the individual high pressure volumes 24 which are assigned to the respective cylinder 14 or the respective cylinders 14 open via a channel 28 which can also be configured as a simple bore in alternative embodiments. The common high pressure volume 26 receives the pressurized (compressed) refrigerant, $CO_2$ in the embodiment described here, of all cylinders 14 or individual high pressure volumes 24 which are assigned to the respective cylinders 14.

Furthermore, the compressor 10 has an outlet 30 for outputting the refrigerant from the compressor, which outlet 30 has an outlet flange 32. As viewed in a flow direction of the refrigerant during normal operation of the compressor 10, a shut-off valve 34 is arranged upstream of the outlet 30, in order for it to be possible to close the outlet accordingly.

The compressor 10 has an impedance tube 36 for damping pulsations which are produced during the operation of the compressor 10, in particular during the ejection of compressed refrigerant from the respective cylinder 14, and also for damping noise which is brought about by way of the pulsations. The impedance tube 36 is arranged in the connection between the common high pressure volume 26 and the shut-off valve 34. In the embodiment which is described here, the connection between the common high pressure volume 26 and the shut-off valve 34 is even formed by way of the impedance tube 36. In alternative embodiments, the impedance tube 36 can also extend only over a part of the connection between the common high pressure volume and the shut-off valve 34 or can form a part thereof.

By way of the reflection of pulsations or vibrations at the respective tube ends, the impedance tube 36 acts in a targeted manner as a vibration damper. To this end, the impedance tube has a volume connected upstream and a volume connected downstream, in order to achieve a freedom from feedback. The volume which is connected upstream is formed by way of the common high pressure volume 26, and the volume which is connected downstream is formed by way of a volume of the application, into which the compressor is integrated, that is to say, for example, a refrigeration system or an air conditioning system (for example, by way of the input volume thereof). The outlet flange 32 is provided on the compressor for connection to the volume which is connected downstream. In other words, the compressor is configured for connection to a volume which is connected downstream of the impedance tube 36.

The concept of the present invention also comprises a refrigeration system and an air conditioning system which have a compressor according to the invention. Here, the volume which is connected downstream of the compressor is configured in the corresponding refrigeration system or air conditioning system. In other words, the present disclosure also comprises a refrigeration system, in particular a transport refrigeration system or a stationary refrigeration system, which has a compressor 10 and a volume which is connected to the outlet 30 of the compressor. Furthermore, the concept of the present disclosure comprises an air conditioning system, in particular an air conditioning system for stationary applications or an air conditioning system for mobile applications, having a compressor 10 and a volume which is connected to the outlet 30 of the compressor.

The impedance tube 36 has a constant cross section, variations in the cross section, in particular steps or step-like widened portions and/or constrictions being conceivable in alternative embodiments. Here, the specific configuration depends, in particular, on the flow conditions which prevail in the compressor 10.

The compressor 10 has a compressor housing 38. The impedance tube 36 is fastened to the compressor housing 38, said impedance tube 36 having a thread for screwing to the compressor housing 38, for fastening to the latter. In the presently described embodiment, the impedance tube 36 is integrated completely into the hermetically sealed refrigeration circuit of the compressor 10, as a result of which the use of seals can be dispensed with. Accordingly, this is a seal-less integration of the impedance tube 36 into the compressor 10. It is also conceivable in alternative embodiments to arrange the impedance tube with a seal in the compressor; in other words, a sealed variant is also additionally conceivable which can also possibly be retrofitted into a compressor.

In the present embodiment, the impedance tube 36 extends from the common high pressure volume 26 as far as the shut-off device (shut-off valve 34) which is connected upstream of the outlet 30. In embodiments, in which a shut-off apparatus can be dispensed with, the impedance tube can extend as far as the outlet 30. In the present embodiment, the impedance tube 36 does not have a bend or curvature; in other words, the impedance tube 36 is arranged as a tube of straight configuration at a corresponding point.

The length of the impedance tube 36 is optionally adapted in such a way that the incoming vibration waves are freed of their harmonics in a targeted manner (impedance tube length $1=\lambda/4$ or parts thereof), and 1 (=the wavelength of the incoming wave and therefore the incoming wave) or multiples thereof (harmonics) is/are extinguished. Pulsations can be reduced with low losses to 10-20% by way of said arrangement. The following relation applies here: $\lambda=c/f$ ($\lambda$=wavelength, f=frequency and c=speed of sound).

Although the invention is described using embodiments with fixed combinations of features, it also comprises the conceivable further advantageous combinations, however, as specified, in particular but not exhaustively, by way of the subclaims. All of the features which are disclosed in the application documents are claimed as essential to the invention, in so far as they are novel over the prior art individually or in combination.

LIST OF DESIGNATIONS

10 Compressor
12 Piston
14 Cylinder bore or cylinder
16 Cylinder block
18 Double arrow
20 Valve plate
21 Inlet valve
22 Outlet valve

24 High pressure volume
26 Common high pressure volume
28 Channel
30 Outlet
32 Outlet flange
34 Shut-off valve
36 Impedance tube
38 Compressor housing

The invention claimed is:

1. A compressor for compressing a refrigerant, having at least one piston and at least one cylinder block, and a compressor housing which encloses the compressor at least partially, the at least one piston being arranged to move to and fro in a cylinder arranged at least partially in the at least one cylinder block or in the compressor housing, the compressor further comprising an impedance tube, an outlet for outputting the refrigerant from the compressor, and a shut-off, wherein for the cylinder, the compressor has an associated high pressure volume and a common high pressure volume in the compressor housing downstream of the associated high pressure volume, into which the associated high pressure volume opens, the common high pressure volume being connected to the outlet, and the impedance tube is arranged in a connection between the common high pressure volume and the outlet, or forms a connection between the common high pressure volume and the outlet, wherein the impedance tube acts as a vibration damper of pulsations or vibrations, wherein, to dampen the pulsations or vibrations, the impedance tube extends into the common high pressure volume and has one end residing in the common high pressure volume defining an internal volume inside the common high pressure volume that is surrounded by the common high pressure volume, wherein to avoid feedback, at another end thereof, the impedance tube is connectable to a volume downstream of the impedance tube and downstream of the outlet for outputting the refrigerant from the compressor, and wherein the shut-off apparatus is connected to the another end of the impedance tube opposite the one end and is located between the impedance tube and the volume downstream of the impedance tube.

2. The compressor as claimed in claim 1, wherein the impedance tube extends as far as directly to the outlet, or as far as the shut-off apparatus, which is connected upstream of the outlet.

3. The compressor as claimed in claim 2, wherein the shut-off apparatus is a valve.

4. The compressor as claimed in claim 1, wherein the impedance tube has a thread for screwing onto the compressor housing.

5. The compressor as claimed in claim 1, wherein the associated high pressure volume and the common high pressure volume are connected via a channel or a bore.

6. The compressor as claimed in claim 1, wherein the compressor is provided for compressing CO2 as refrigerant.

7. The compressor as claimed in claim 1, wherein the impedance tube has a constant cross section.

8. The compressor as claimed in claim 1, wherein the associated high pressure volume and the common high pressure volume are combined.

9. The compressor as claimed in claim 1, wherein the impedance tube has a length (l) which corresponds to a quarter of the wavelength ($\lambda$) of the pulsation or vibration to be reduced or to a harmonic, or which corresponds to $l=\lambda/4n$, in which n is a positive integer that is more than one.

10. A refrigeration system having a compressor as claimed in claim 1 and further wherein the volume downstream of the impedance tube and downstream of the outlet is connected to the outlet of the compressor.

11. The compressor as claimed in claim 1, further comprising an outlet flange for connecting the compressor to the volume downstream of the impedance tube.

12. The refrigeration system as claimed in claim 10, wherein the refrigeration system comprises a transport refrigeration system.

13. The refrigeration system as claimed in claim 10, wherein the refrigeration system comprises a stationary refrigeration system.

14. The compressor as claimed in claim 1, wherein the outlet is an outlet flange.

15. The compressor as claimed in claim 1, wherein the impedance tube resides entirely within the compressor housing.

16. An air conditioning system having a compressor as claimed in claim 1 and further wherein the volume downstream of the impedance tube and downstream of the outlet is connected to the outlet of the compressor.

17. The air conditioning system as claimed in claim 16, wherein the air conditioning system is for stationary applications.

18. The air conditioning system as claimed in claim 16, wherein the air conditioning system for mobile applications.

* * * * *